United States Patent [19]

Kurihara

[11] 4,337,122

[45] Jun. 29, 1982

[54] COKE OVEN DOOR

[75] Inventor: Tetsuo Kurihara, Matsuda, Japan

[73] Assignee: Koritsu Machine Industries, Ltd., Tokyo, Japan

[21] Appl. No.: 218,023

[22] Filed: Dec. 19, 1980

[51] Int. Cl.[3] ..... C10B 25/06; C10B 25/12; C10B 25/16

[52] U.S. Cl. ..... 202/248; 202/269

[58] Field of Search ..... 202/248, 269, 242–247, 202/249–252; 49/480, 481, 485; 110/173 R

[56] References Cited

U.S. PATENT DOCUMENTS

| | | | |
|---|---|---|---|
| 2,157,569 | 5/1939 | Potter | 202/248 |
| 2,195,840 | 4/1940 | Potter | 202/248 |
| 3,162,584 | 12/1964 | Cremer et al. | 202/248 |
| 3,273,360 | 9/1966 | Tucker | 202/248 |
| 3,486,986 | 12/1969 | Freund | 202/248 |
| 4,107,879 | 8/1978 | Steimann | 202/248 |
| 4,131,421 | 12/1978 | Abendroth | 202/248 |
| 4,189,352 | 2/1980 | Stanke | 202/248 |

FOREIGN PATENT DOCUMENTS

| | | | |
|---|---|---|---|
| 1809880 | 6/1970 | Fed. Rep. of Germany | 202/248 |

*Primary Examiner*—Bradley Garris
*Attorney, Agent, or Firm*—Karl H. Gross

[57] ABSTRACT

A new and useful coke oven door which is simple in construction but provides complete sealing efficiency. A pair of supporting holes are formed on each of upper and lower portions of the side plates of the door body, and through the supporting holes a locking bar extends which has on the center portion an arm for rotating and on both ends rollers eccentrically located with respect thereto. By rotating the locking bar with the arm, the door can be moved slightly backward or forward when removing or installating lest the knife edge should scratch the door sealing frame.

3 Claims, 6 Drawing Figures

COKE OVEN DOOR

BACKGROUND OF THE INVENTION

The present invention relates to a coke oven door, more particularly to a coke oven door provided with locking bar units mounted so as to extend through holes on the side plates of the door body and having such construction that on both ends thereof are eccentrically mounted rollers for engaging with latching hooks on the sealing frame.

The conventional coke oven doors for closing the coke oven mouths on both pusher and coke sides are provided with upper and lower locking bar boxes each of which is spring loaded. Thus, when a plurality of spring loaded pushers for depressing door knife edge are mounted on the outer surface of the door body, there must be balance between the total pressure of the spring loaded pushers and the pressure of the locking bars. And, if the total pressure of the pushers is increased in disregard of the balance, the compression springs in the bar boxes are always overpressed by the differential pressure. This results in decreased margin of spring pressure of the locking bars which is required when releasing it for installation and removal of the door and thus apt to interfere with removal and installation operations or damage to the knife edge.

Further, the conventional locking bars have only the function of engaging with the latching hooks projecting from the sealing frame.

SUMMARY OF THE INVENTION

The present invention has been made in the light of the above aspects, and provides a new and useful coke oven door which is simple in construction but capable of securely preventing the coke oven gas from leaking through the oven mouths by pressure-contacting the knife edge into the sealing frame.

In accordance with the present invention, the coke oven door generally includes an outer side door body and an inner side firebrick layer, and both lower and upper portions of the side plates of the door body are formed with supporting holes through which rotatable locking bars are mounted respectively. On the both ends of each locking bar are mounted rollers eccentrically with respect to the longitudinal axis line of the locking bar to be engaged with the latching hooks projecting from the sealing frame of the coke oven. The locking bar boxes containing the spring are not used here, and thus the spring pressure of the spring loaded pushers which are mounted in plural number on the outer surface of the door body can be freely adjusted regardless of the pressure of the locking bars.

Since the locking bars are rotatably mounted through the supporting holes and the rollers are eccentrically mounted on both ends thereof, if the rollers are moved on the latching hooks by lifting or lowering the arm of the locking bar, the door body is slightly drawn back or pushed forth. Therefore, the knife edge can be prevented from scratching the door frame upon removal or installation of the door from or onto the coke oven mouth.

BRIEF DESCRIPTION OF THE DRAWINGS

The objects and advantages of the present invention will be apparent from the following description with reference to the accompanying drawings, in which.

DESCRIPTION OF A PREFERRED EMBODIMENT

Figure 2:
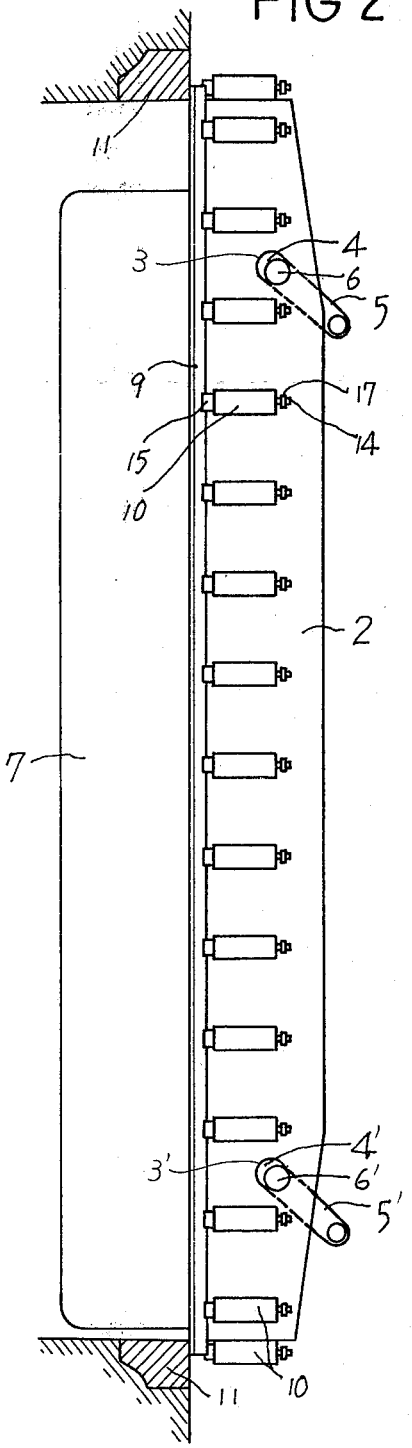
FIG. 2 is a side elevation of the door showing it installed onto the coke oven mouth.
Figure 1:
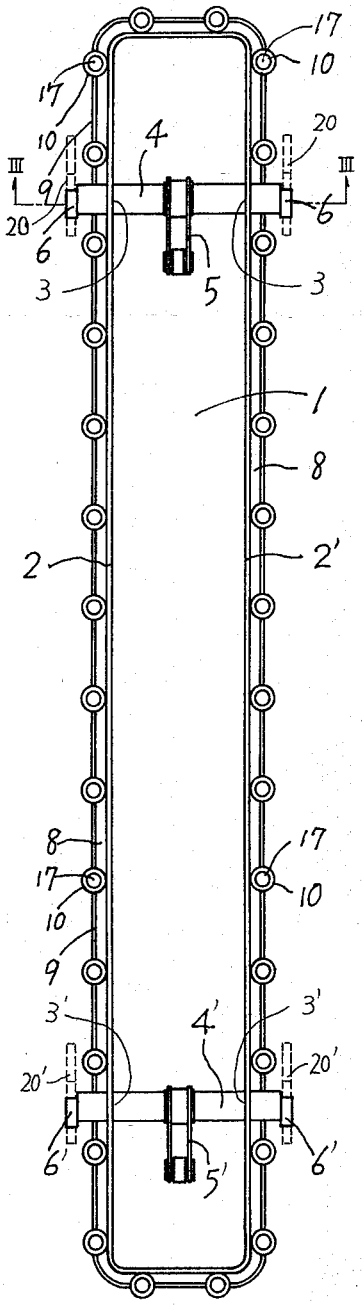
FIG. 1 is a front elevation of a coke oven door according to the present invention.

Referring now to FIGS. 1 and 2, there are rotatably and horizontally mounted a pair of upper and lower locking bars 4, 4' respectively extending through supporting holes 3, 3' formed on upper and lower portions of side plates 2, 2' of a door body 1. On each center portion of the locking bar 4, 4' is secured an arm member 5, 5' for rotating the locking bar 4, 4'. On both ends of the locking bar 4, 4' are mounted rollers 6, 6, 6', 6' located eccentrically with respect to the axis line of the locking bars 4, 4', as if each locking bar and the roller's shafts (not shown) constitute a crank shaft, which is integrally formed or assembled. The arms 5, 5' and the rollers 6, 6, 6', 6' are located in the same direction with respect to the locking bars 4, 4'. However, it is to be noted that such locations of the arm and rollers may be different from each other and the essential feature of the present invention is relative location of the rollers with respect to the axis line of the locking bar, in other words, the rollers are positioned on a different axis line from that of the locking bar.

Figure 3:
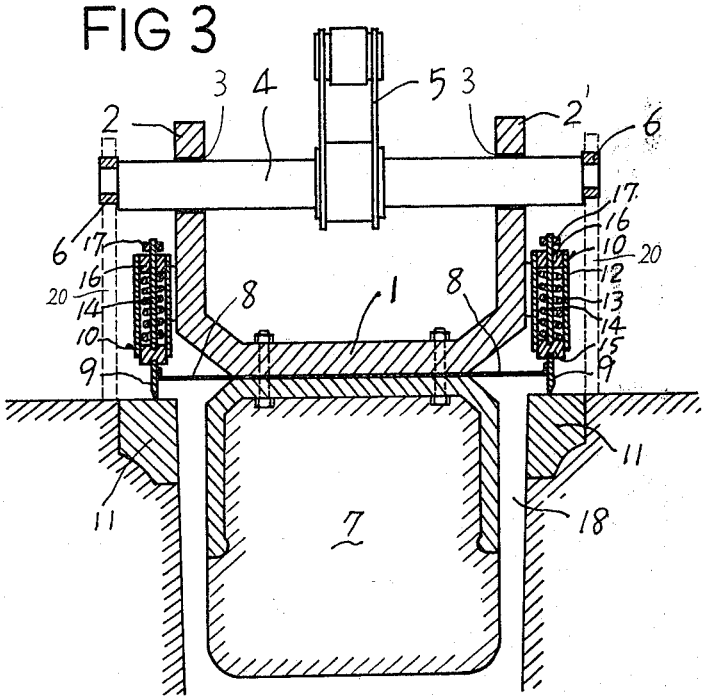
FIG. 3 is a cross-sectional view generally taken along the section line III—III in FIG. 1.

Referring now to FIG. 3, the reference numeral 7 denotes a firebrick layer secured on inner side of the door body 1, and the reference numeral 8 denotes a sealing plate mounted between the door body 1 and the firebrick layer 7. On the entire periphery of the sealing plate 8 is secured an endless knife edge 9, which is also seen in FIGS. 1 and 2. The reference numeral 10 denotes a plural number of spring-loaded knife edge pushers mounted on the outer side of the door body 1, which engage with the rear end of the knife edge 9 to depress it against the door sealing frame 11 for pressure-contacting thereto.

Each knife edge pusher 10 comprises a case 12, a coil spring 13, a rod 14, a depressing member 15, an adjustment screw member 16 and a nut 17 serving as a stopper. When the adjustment screw member 16 is threaded into the case 12, then the pressure of the coil spring 13 is increased. The space between the adjustment screw member 16 and the stopper nut 17 provides a play for the depressing member 15 to be additionally depressed. The reference numeral 18 denotes the coke oven mouth, and the reference numeral 20 denotes a latching hook.

Figure 6:
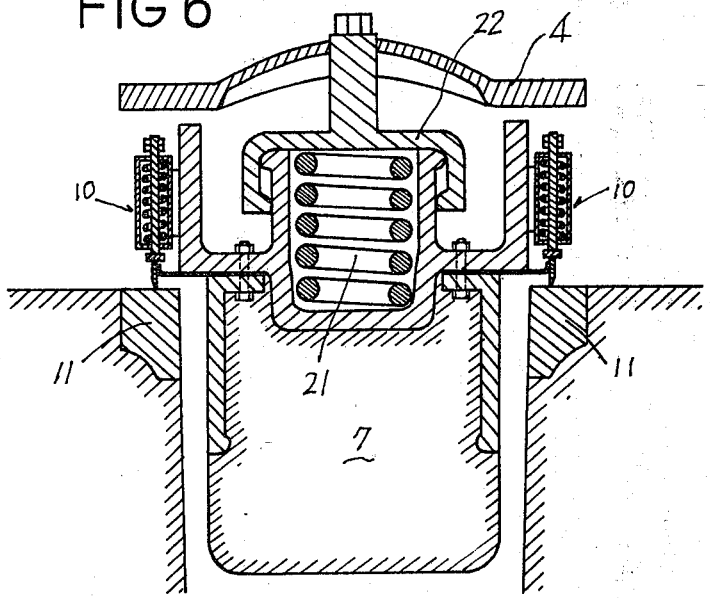
FIG. 6 is a cross-sectional view of a conventional coke oven door similar to FIG. 3.

Comparing to a conventional coke oven door shown in FIG. 6 for clarifying purpose, the coke oven door of the present invention which is constructed as above does not include such locking bar box 22 that contains a coil spring 21 for pushing the locking bar, and thus it is no longer required that the total pressure of the knife edge pusher 10 should be balanced to the spring pressure of the locking bar box and thus the spring pressure of the knife edge pusher may be adjusted to increase the pressure against the knife edge 9. This provides complete sealing of the oven mouth by means of the knife edge 9 pressure-contacted onto the door sealing frame 11 and thus securely prevents the leakage of the oven gas.

Figure 4:
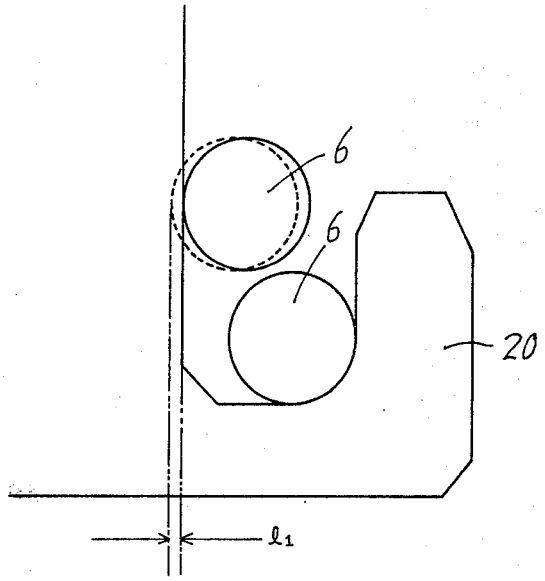
FIG. 4 is an enlarged explanatory view showing slight backward movement of a roller eccentrically mounted on the end of a locking bar upon removal of the door.
Figure 5:
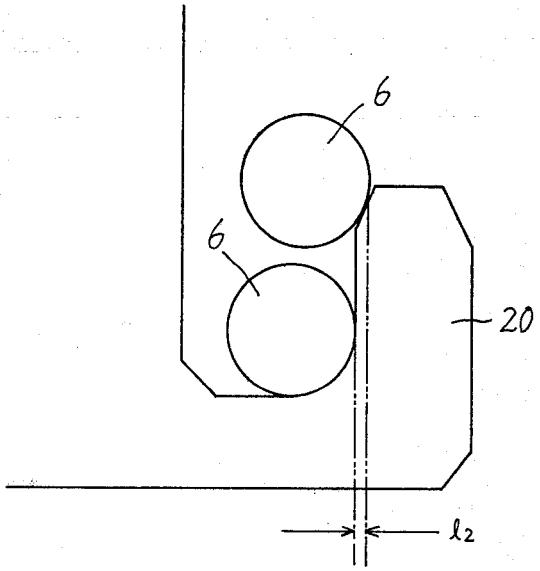
FIG. 5 is a similar view to FIG. 4, showing the slight forward movement of the door.

On the other hand, since the locking bars 4, 4' are rotatable and the eccentrically mounted rollers 6, 6, 6', 6' on both ends thereof are moved with the locking bars in the latching hooks 20, 20', the door can be slightly drawn back by the distance $l_1$ as shown in FIG. 4 in the initial stage of the removal operation from the latching hook 20 and the door mouth 18, lest the knife edge 9 should scratch the door sealing frame 11. While, in the last stage of installation there-of, the door can be slightly pushed forth by distance $l_2$ of the same value as above $l_1$ so as to ensure complete sealing of the coke oven mouth 18 by means of the knife edge accordingly pushed forth onto the door sealing frame 11. These slight forth and backward movements of the door can prevent eventual scratching of the door sealing frame by the knife edge on removal and installation operations of the door.

What is claimed:

1. In a coke oven, a combination comprising a door body having side plates; upper and lower supporting holes formed horizontally in said side plates; upper and lower locking bars each extending through one of said holes and having an axis of rotation and two spaced ends; and a pair of rollers mounted on each of said locking bars at the respective ends thereof and turnable about an axis which is eccentric relative to said axis of rotation, said rollers being adapted for engagement with latching hooks projecting from the sealing frame of the door.

2. A combination as defined in claim 1; and further comprising a knife-edge sealing member on said door at a side thereof facing the coke oven.

3. A combination as defined in claim 1; and further comprising an operating arm engaging a center portion of each locking bar and extending transverse to said axis of rotation, so as to rotate the locking bar.

* * * * *